US012022857B2

(12) United States Patent
Shoor et al.

(10) Patent No.: US 12,022,857 B2
(45) **Date of Patent: *Jul. 2, 2024**

(54) HOLLOW CONICAL MEMBER WITH FLAVOR CAPSULE

(71) Applicant: Good Tree International, Inc., Jurupa Valley, CA (US)

(72) Inventors: Kunal Shoor, Ontario, CA (US); Brandon Puett, Ontario, CA (US)

(73) Assignee: Good Tree International, Inc., Jurupa Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/313,109

(22) Filed: May 5, 2023

(65) Prior Publication Data

US 2023/0270155 A1 Aug. 31, 2023

Related U.S. Application Data

(63) Continuation of application No. 17/211,517, filed on Mar. 24, 2021, now Pat. No. 11,744,281.

(51) Int. Cl.

| | |
|---|---|
| ***A24D 1/02*** | (2006.01) |
| ***A24D 1/00*** | (2020.01) |
| ***A24D 1/18*** | (2006.01) |
| ***A24D 3/08*** | (2006.01) |

(Continued)

(52) U.S. Cl.

CPC ..... *A24D 1/02* (2013.01); *A24D 1/002* (2013.01); *A24D 1/18* (2013.01); *A24D 3/08* (2013.01); *A24D 3/048* (2013.01); *A24D 3/061* (2013.01)

(58) Field of Classification Search

CPC ..... A24D 3/061; A24D 3/048; A24D 3/08; A24D 3/18; A24D 1/02; A24D 1/022

See application file for complete search history.

(56) References Cited

U.S. PATENT DOCUMENTS

| | | | |
|---|---|---|---|
| 3,199,515 | A | 8/1965 | Lowe |
| 3,490,461 | A | 1/1970 | Osmalov |
| 3,550,508 | A | 12/1970 | Wartman, Jr. |

(Continued)

FOREIGN PATENT DOCUMENTS

| | | |
|---|---|---|
| CN | 101203148 B | 9/2012 |
| GB | 2549803 | 11/2017 |

(Continued)

OTHER PUBLICATIONS

Amazon King Palm, Jul. 24, 2018 (Year: 2018), 2 pages.

(Continued)

*Primary Examiner* — Linda L Gray

(74) *Attorney, Agent, or Firm* — Sheppard Mullin Richter & Hampton LLP

(57) ABSTRACT

A device for burning smoking material and inhaling the resulting smoke is disclosed. The device can include an truncated conical member formed from a material having an internal elongated cavity extending from an open end to a closed end. The elongated cavity can be configured to receive a smoking material. The smoking accessory can include a filter disposed within the truncated conical member and defining the closed end. The filter can have a recess formed in a surface of the body along a curved face extending from the first end to the second end, the recess extending radially into the body. The smoking accessory can include a capsule containing a flavoring agent disposed within the recess.

19 Claims, 5 Drawing Sheets

(51) Int. Cl.
*A24D 3/04* (2006.01)
*A24D 3/06* (2006.01)

(56) References Cited

U.S. PATENT DOCUMENTS

| | | | |
|---|---|---|---|
| 3,910,288 | A | 10/1975 | Hammersmith |
| 4,865,056 | A | 9/1989 | Tamaoki |
| 4,889,144 | A | 12/1989 | Tateno |
| 5,568,819 | A | 10/1996 | Gentry |
| 6,041,790 | A | 3/2000 | Smith |
| 7,152,609 | B2 | 12/2006 | Li |
| 7,578,298 | B2 | 8/2009 | Karles |
| 7,793,665 | B2 | 9/2010 | Dube |
| 7,827,997 | B2 | 11/2010 | Crooks |
| 7,836,895 | B2 | 11/2010 | Dube |
| 7,856,992 | B2 | 12/2010 | Zhou |
| 7,878,962 | B2 | 2/2011 | Karles |
| 7,984,719 | B2 | 7/2011 | Dube |
| 8,051,859 | B2 | 11/2011 | Yadav |
| 8,066,011 | B2 | 11/2011 | Clark |
| 8,118,035 | B2 | 2/2012 | Miser |
| 8,235,056 | B2 | 8/2012 | Zhuang |
| 8,356,607 | B2 | 1/2013 | Inoue |
| 8,459,272 | B2 | 6/2013 | Karles |
| 8,739,802 | B2 | 6/2014 | Fagg |
| 9,010,337 | B2 | 4/2015 | Kobal |
| 9,066,541 | B2 | 6/2015 | Allen |
| 9,107,452 | B2 | 8/2015 | Deevi |
| 9,119,421 | B2 | 9/2015 | Li |
| 9,149,072 | B2 | 10/2015 | Conner |
| 9,307,788 | B2 | 4/2016 | Dube |
| 9,332,786 | B2 | 5/2016 | Yokogawa |
| 9,554,594 | B2 | 1/2017 | Clark |
| 9,872,517 | B2 | 1/2018 | Reed |
| 9,907,335 | B2 | 3/2018 | Karles |
| 10,321,710 | B2 | 6/2019 | Kobal |
| 10,357,057 | B2 | 7/2019 | Kadiric |
| 10,568,356 | B2 | 2/2020 | Karles |
| 10,609,955 | B2 | 4/2020 | Beard |
| 10,736,351 | B2 | 8/2020 | Kaihatsu |
| 10,765,143 | B2 | 9/2020 | Mishra |
| 10,893,700 | B2 | 1/2021 | Mishra |
| 11,019,842 | B2 | 6/2021 | Dube |
| 11,076,632 | B1 | 8/2021 | Ormaza |
| 11,311,044 | B2 | 4/2022 | Shoor |
| 2006/0078608 | A1 | 4/2006 | Gilinski |
| 2006/0135335 | A1 | 6/2006 | Dawson |
| 2006/0174901 | A1 | 8/2006 | Karles |
| 2007/0012327 | A1 | 1/2007 | Karles |
| 2007/0068543 | A1 | 3/2007 | Chen |
| 2007/0246054 | A1 | 10/2007 | Gedevanishvili |
| 2011/0023896 | A1 | 2/2011 | Dube |
| 2012/0024303 | A1 | 2/2012 | Sugai |
| 2012/0097179 | A1 | 4/2012 | Kesselman |
| 2012/0255569 | A1 | 10/2012 | Beard |
| 2013/0333710 | A1 | 12/2013 | Brown |
| 2014/0053855 | A1 | 2/2014 | Hartmann |
| 2014/0332014 | A1 | 11/2014 | Penrose |
| 2015/0027477 | A1 | 1/2015 | Yoshino |
| 2015/0164133 | A1 | 6/2015 | Davis |
| 2015/0296875 | A1 | 10/2015 | Camus |
| 2017/0000185 | A1 | 1/2017 | Risso |
| 2018/0160724 | A1 | 6/2018 | Guyard |
| 2020/0100539 | A1 | 4/2020 | Mendoza |
| 2020/0146340 | A1 | 5/2020 | Alderman |

FOREIGN PATENT DOCUMENTS

| | | | |
|---|---|---|---|
| KR | 20070100422 | | 10/2007 |
| UA | 105677 | C2 | 6/2014 |
| WO | 03009711 | | 2/2003 |
| WO | 2015014610 | | 2/2015 |
| WO | 2015091792 | | 6/2015 |
| WO | 2020142002 | | 7/2020 |
| WO | 2022129613 | | 6/2022 |

OTHER PUBLICATIONS

English machine translation of abstract of CN 10372641 0A; Apr. 16, 2014; Liu; 2 pages. (Year: 2014).
English machine translation of abstract of WO 9725886 A1; Roca; Jul. 24, 1997; 4 pages. (Year: 1997).
English machine translation of CN 105813483 A; Jul. 27, 2016; Reed; 19 pages. (Year: 2016).
English machine translation of JP 2017503477 A1; Feb. 2, 2017; 13 pages. (Year: 2017).
English machine translation of KR20070100422; Oct. 10, 2007; 14 pages; Karles. (Year: 2007).
English machine translation of TW202041156A; Nov. 16, 2020; Kiew; 46 pages. (Year: 2020).
English machine translation of UA 105677 C2; Jun. 10, 2014; 38 pages. (Year: 2014).
English machine translation of WO 2011086751 A1; Kato; Jul. 21, 2011; 31 pages. (Year: 2011).
King Palm "About Us" web page at <URL: https://kingpalm.com/about>, Feb. 2019, retrieved from the Internet at <URL: https://web.archive.org/web/20190205084640/https://kingpalm.com/about#>, on Nov. 8, 2022, 4 pages.
King Palm "High Quality Natural Palm Leaf Blunts" web page at <URL: https://kingpalm.com/>, Jun. 12, 2018, retrieved from the Internet at <URL: https://web.archive.org/web/20180612075453/https://kingpalm.com/>, on Nov. 8, 2022, 4 pages.
King Palm; Feb. 1, 2021; 1 page. (Year: 2021).
Natural Blunt Wraps; 2020; 28 pages. (Year: 2020).
Wayback Machine for cordia Natural Blunt Wraps; 2020; 1 page. (Year: 2020).
Wayback Machine for cordia Wikipedia; 2004; 1 page. (Year: 2004).
Wayback Machine for King Palm; Feb. 1, 2021; 1 page. (Year: 2021).
Wikipedia for cordia; 2004; 8 pages. (Year: 2004).
King Palm Corn Husk Filters, Amazon.com, 2018, [online], retrieved from the Internet, [retrieved Nov. 28, 2023], <URL: https://www.amazon.com/King-Palm-Filters-Natural-Effective/dp/B07FTX7HLS>, (Year: 2018), 2 pages.
King Palm Slim Size Cones, Amazon.com, 2017, [online], retrieved from the Internet, [retrieved Nov. 28, 2023], <URL: https://www.amazon.com/Slim-Size-Palm-Leafs-Pack/dp/B077GBKCDX/ref=sr_1_6?crid=3C7HBR2ONZMWI&keywords=king%2Bpalm%2Bcones&qid=1701208254&s=hpc&sprefix=King%2BPalm%2Chpc%2C92&sr=1-6&th=1 >, (Year: 2017), 4 pages.

HOLLOW CONICAL MEMBER WITH FLAVOR CAPSULE

CROSS-REFERENCE TO RELATED APPLICATIONS

This application is a continuation of U.S. patent application Ser. No. 17/211,517, filed Mar. 24, 2021, entitled "Hollow Conical Member with Flavor Capsule", which is hereby incorporated herein by reference in its entirety.

BACKGROUND

Technical Field

This disclosure relates to flavored smoking materials. More specifically, this disclosure relates to a hollow member having a flavor capsule contained within a filter element.

Related Art

Hand-rolled cigarettes, cigars, or cigarillos generally do not have an incorporated filter. Filters can be purchased and included in such a hand-rolled smoke, but these are commonly formed from synthetic materials such as cellulose acetate (a plastic) and rayon. The cellulose acetate tow fibers are thinner than sewing thread, white, and packed tightly together to form a filter element and included in the hand-rolled smoke. Burning or inhaling such synthetic fibers can create hazardous situation for the smoker. In addition, flavors are not easily added to hand-rolled cigarettes, cigars, or cigarillos.

SUMMARY

One aspect of the disclosure provides a smoking accessory. The smoking accessory can include an truncated conical member having an internal elongated cavity extending from an open end to a closed end, the elongated cavity being configured to receive a smoking material. The smoking accessory can include a filter disposed within the elongated cavity and defining the closed end. The filter can have a body extending from a first end to a second end. The filter can have a recess formed in a surface of the body along a curved face extending from the first end to the second end, the recess extending radially into the body. The smoking accessory can include a capsule containing a flavoring agent disposed within the recess.

The filter can have a filter wrapper and a filter element. The filter can be independently wrapped and contained by a friction within the elongated cavity of the truncated conical member. The filter wrapper can include at least one piece of natural fiber string. Crushing the capsule disperses the flavoring agent within the filter to impart a flavor into the smoke. The recess can completely penetrate the filter.

Another aspect of the disclosure provides a hollow leaf member. The hollow leaf member can have a truncated conical shape having an internal elongated cavity extending from a first end to a second end. The elongated cavity can receive a smoking material. The hollow leaf member can have a filter having a body and a recess formed in a surface of the body, the recess extending radially through the body. The elongated member can have a capsule containing a flavoring agent disposed within the recess.

Other features and advantages will be apparent to one of ordinary skill with a review of the following description.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which.

DETAILED DESCRIPTION

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
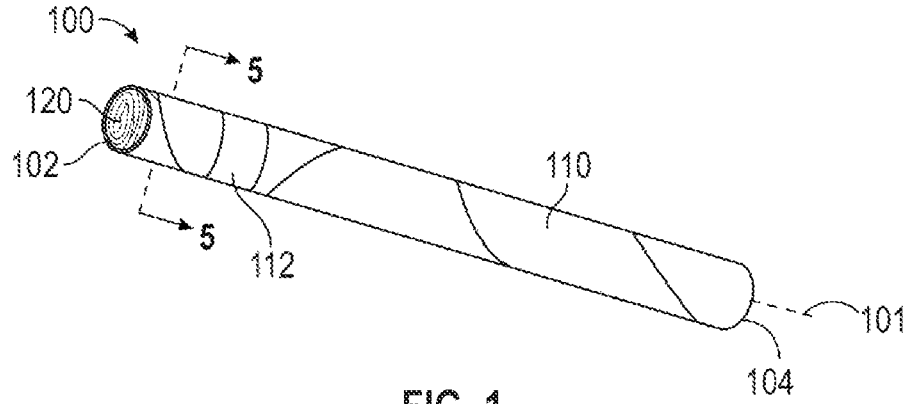
FIG. 1 is a perspective view of an embodiment of a hollow tube.

FIG. 1 is a perspective view of an embodiment of a hollow elongated member. In the illustrative example of FIG. 1, the hollow member can be a hollow tubular member (referred to herein as a hollow tube 100) formed from one or more sheets of material 110. The material 110 can extend from a first end 102 to a second end 104. The first end 102 can have a filter 120, forming a closed end of the hollow tube 100. The hollow tube 100 can have a central axis 101 following an imaginary line through the center of the hollow tub from the first end 102 to the second end 104. The description refers to axial and radial directions. Axial refers to directions along the central axis 101, while radial refers to a direction orthogonal to the central axis 101.

Figure 2:
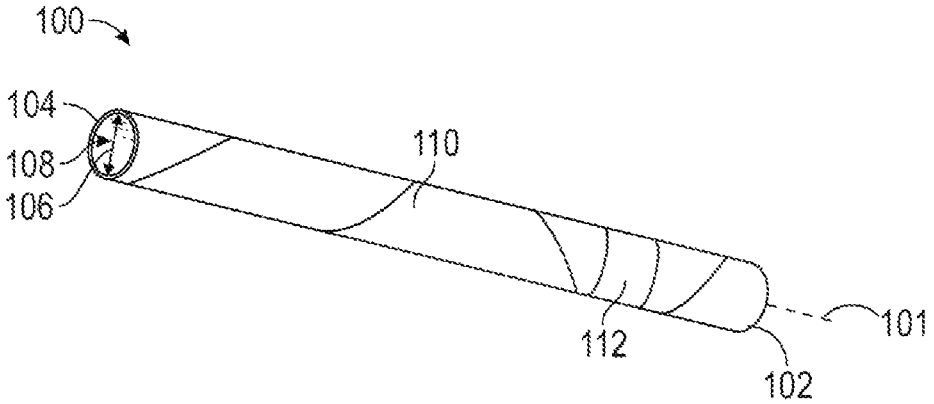
FIG. 2 is another perspective view of the hollow tube of FIG. 1.

FIG. 2 is another perspective view of the hollow tube of FIG. 1. FIG. 1 and FIG. 2 are referenced in the following description.

The second end 104 can open into an elongated internal cavity 108 having an inner diameter 106. The internal cavity 108 can receive a smoking material 140 (see FIG. 7). In some implementations, the material 110 can be a dried leaf, such as any natural plant leaf that can be rolled into a tube. In some examples, the material 110 can be a tree or plant leaf such as, Cordia, manjack, bocote, palm, or other leaves. Cordia is a primary example used herein, but is not limiting on the disclosure. Cordia can include flowering plants (e.g., shrubs and trees) in the borage family, Boraginaceae. In general, the material 110 can be a thick, pure and all natural leaf (i.e., no additives), without glue or other adhesives, and green leaf. The material 110 can also be tobacco free. The material 110 can provide a resilient and aesthetically appealing green that burns slowly.

In some implementations, the material 110 can be a paper material, such as any thin sheet material produced by processing fibers derived from plant or tree sources in water and then pressing and drying the material produce a sheet of material 110. The paper material can be any type of paper, such as but not limited to, rice paper, hemp paper, palm paper (e.g. made by processing Cordia fibers), wood pulp, bleached paper (e.g., sometimes referred to as white paper), unbleached paper (e.g., sometimes referred to as brown paper), clear paper (e.g., paper made from cellulose resulting in a clear sheet), colored papers, gold rolling papers. For example, different paper material may be used to provide differing aesthetics, such as different colored papers or papers having designs printed thereon. In various examples, the material 110 may be entirely made of palm paper (e.g. made by processing Cordia fibers). Using paper material, such as hemp paper, palm paper, etc., may provide benefits, such as for example but not limited to, being thinner and more flexible than the dried leaf embodiments described above. Particularly, palm paper may provide a material that is both thin and flexible, while resilient to breakage and/or tearing. Another benefit of palm paper is that palm paper is one of the slowest burning papers and is tobacco-free. The Cordia leaf (or fibers therefrom) is durable and absorbs liquid (e.g., from the capsule 130 as described below) in a manner that is more resilient than that provided by papers or leaf from other plants.

The leaf and/or paper can be rolled around a form and dried in place to form the material 110 of the hollow tube 100. In some embodiments, one or more sheets of paper (or leaf) may be rolled to form the hollow tube 100, such as a single sheet or leaf, two sheets or leaves, etc. In some other examples, the material 110 can be (partially) dried and then rolled into the desired shape. The material 110 can be secured in a tubular form with a ring 112. The ring 112 can be a section of paper or other appropriate fastener wrapped around and adhered to itself holding the material 110 in its hollow form/tubular shape and prevent the material 110 from unwrapping. The ring 112 can further be adhered to the material 110 to maintain the tubular shape.

Figure 3:
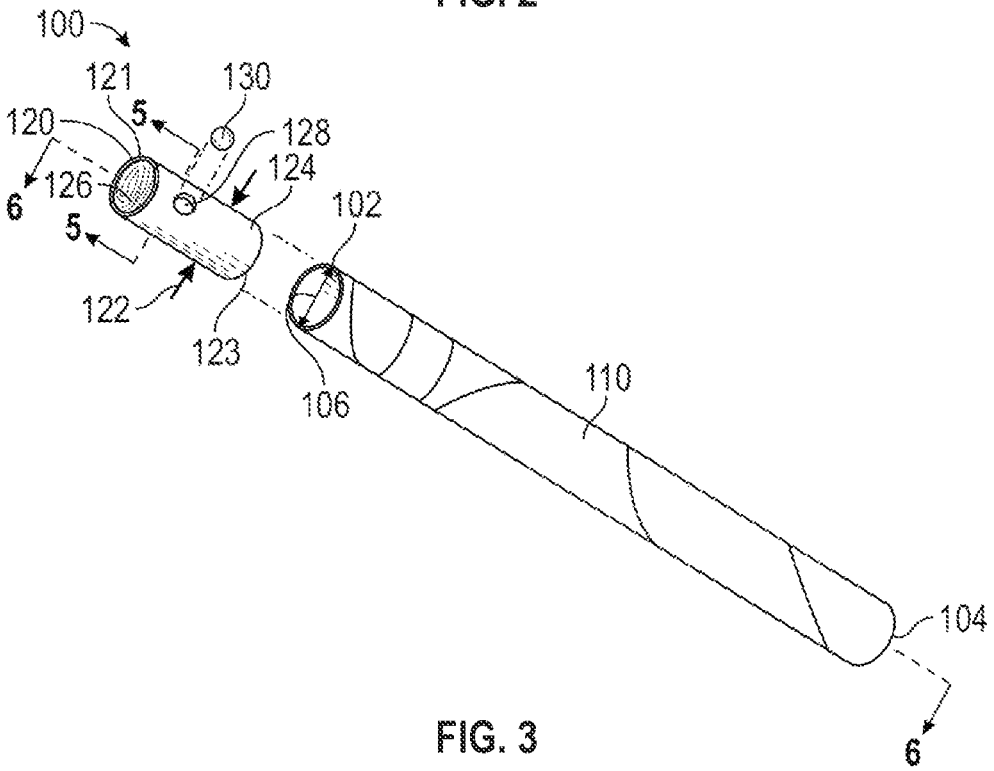
FIG. 3 is an exploded view of the hollow tube of FIG. 1 and FIG. 2.

FIG. 3 is an exploded view of the hollow tube of FIG. 1 and FIG. 2. The filter 120 can have a cylindrical body/shape having an outer diameter 122 extending from a first end 121 to a second end 123. The outer diameter 122 can be approximately equal to the inner diameter 106 of the first end 102 of the hollow tube 100. The filter 120 can be received within the first end 102 in an interference or friction fit. In some examples, the filter 120 can be rolled into the material 110 when forming the hollow tube 100. In some implementations, the filter 120 can be removed and/or replaced from the hollow tube 100 as needed.

The filter 120 can have a filter wrapper 124 (e.g., a plug wrap) enclosing a filter element 126. The filter element 126 can be formed from natural fibers. In some examples, the filter element 126 can be formed by rolling corn husks. The corn husks can be shredded and rolled (e.g., hand-rolled or machine-rolled) into a cylindrical shape, forming the filter element 126. In some implementations, the filter element 126 can be held in the cylindrical shape by the filter wrapper 124. The filter wrapper 124 can be a section of ordinary paper wrapped around the filter element 126. In other implementations, the filter 120 can be completely formed of corn husk without any paper. In some other implementations, the filter wrapper 124 can be one or more sections (e.g., lengths) of string formed from natural fibers. The string can be wrapped and tied around, for example, the ends of the filter element 126 to maintain a round shape.

In some implementations, the filter wrapper 124 can be a paper material as described above in connection to the material 110. The paper material can be any type of paper, such as but not limited to, rice paper, hemp paper, Cordia (also referred to herein as palm paper), wood pulp, bleached paper (e.g., sometimes referred to as white paper), unbleached paper (e.g., sometimes referred to as brown paper), clear paper (e.g., paper made from cellulose resulting in a clear sheet), colored papers, gold rolling papers. In various examples, the filter wrapper 124 may be entirely made of Cordia (e.g., palm paper).

Similarly, the filter element 126 may be made of can be a paper material, such as but not limited to, rice paper, hemp paper, palm paper (e.g. made by processing Cordia fibers), wood pulp, bleached paper (e.g., sometimes referred to as white paper), unbleached paper (e.g., sometimes referred to as brown paper), clear paper (e.g., paper made from cellulose resulting in a clear sheet), etc. In various examples, the material 110 may be entirely made of palm paper (e.g. made by processing Cordia fibers).

In some implementations the hollow tube 100 may be made entirely from a single material, for example, corn husk, paper material, etc. In some implementations, the hollow tube 100 may be made entirely from palm paper (e.g., made from Cordia). For example, the material 110, filter wrapper 124, and filter element 126 may each be formed of palm paper. As another example, the material 110 and the filter wrapper 124 may be formed of palm paper, while the filter element formed of corn husk, or other material as set forth above.

The filter 120 can have a recess 128. The recess 128 can be formed in a surface of the filter 120 along a curved face extending from the first end and the second end.

Figure 4:
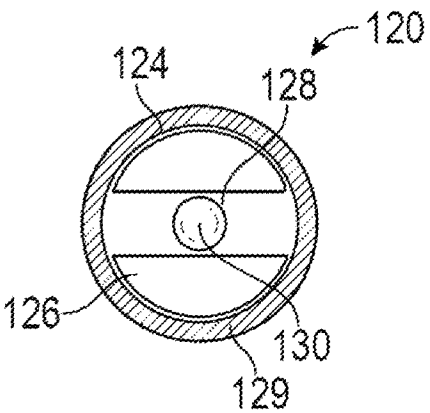
FIG. 4 is a cross-section of an embodiment of the hollow tube taken along the line 5-5 of FIG. 1.

FIG. 4 is a cross-section of an embodiment of the hollow tube taken along the line 5-5 of FIG. 1. The recess 128 can be a cavity or orifice bored, punched, or otherwise formed in the surface of the filter 120. The recess 128 can extend into the cylindrical body of the filter 120. In some implementations, the recess 128 can penetrate the wrapper 124 and extend radially through the filter element 126. The recess 128 can penetrate both the filter wrapper 124 and the filter element 126 extending completely through the filter 120. In other implementations, the recess 128 may not penetrate the wrapper 124 and thus be an indentation in the surface of the wrapper 126 and the filter 120.

In general, a capsule 130 can be set within the recess 128 and thus contained within the recess 128 by the material 110 when the filter 120 is inserted within the hollow tube 100.

The recess 128 can be sized to receive the capsule 130. The capsule 130 can be a flavor capsule containing a flavoring agent. The capsule 130 can be a gelatin capsule. In other implementations, the capsule 130 can be formed from vegetable-based materials (e.g., a vegetable capsule). The flavoring agent can be a fluid operable to penetrate the filter element 126 and impart a flavor on the smoke drawn through the filter 120. The flavoring agent can be released when the capsule 130 is crushed. The flavoring agent within the capsule 130 can be, for example, a food grade essential oil or food grade candy oil. In some implementations, the flavoring agent can also include natural terpene liquid in various flavors (e.g., fruit or dessert flavors).

Figure 5:
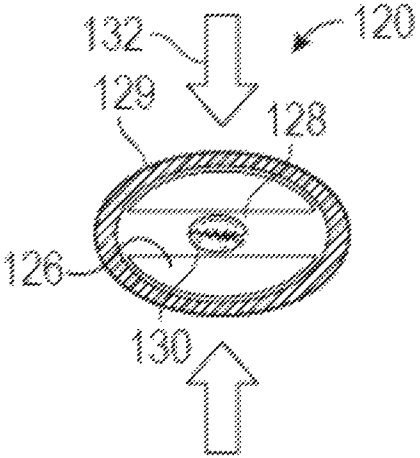
FIG. 5 is another view of the cross section of FIG. 4.

FIG. 5 is another view of the cross section of FIG. 4. When an external force (e.g., a pinching motion) is exerted on the closed end 102 of the hollow tube 100 (e.g., on the filter 120 and the capsule 130), the capsule 130 can be burst, releasing the flavoring agent into the filter element 126. The external force may be applied anywhere along the length of the filter 120 such that the external force induces a pinching force applied to the capsule 130 within the filter element 126, thereby causing the capsule 130 to burst. The flavoring agent can be drawn into smoke that passes through the filter 120.

While the illustrative examples herein provide for a recess 128 formed in the surface of the filter 120, embodiments herein need not be so limited. For example, the recess 128 may be formed within the filter element 126 and the capsule 130 contained therein. In some embodiments, the filter member may be formed around the capsule 130, for example, by packing or rolling the filter element 126 around the capsule 130 forming recessing that contains the capsule 130. The filter wrapper 124 may then be applied and wrapped around the filter element 126. In another example, the filter element 126 may be placed on an unrolled filter wrapper 124 and the capsule 130 placed on the filter element 126 (e.g., in a central position of the filter element 126) and the filter wrapper 124 rolled to form the filter 120, thereby packing or rolling the filter element 126 around the capsule 130.

Figure 6:
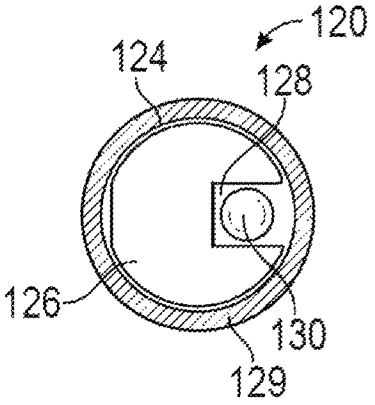
FIG. 6 is a cross-section of another embodiment of the hollow tube taken along the line 5-5 of FIG. 1.

FIG. 6 is a cross-section of another embodiment of the hollow tube taken along the line 5-5 of FIG. 1. In some implementations, the recess 128 can penetrate the wrapper 124 and extend radially into a portion of the filter element 126 but not all the way through the filter 120. Thus, the recess 130 can thus form a pocket within the filter 120.

Figure 7:
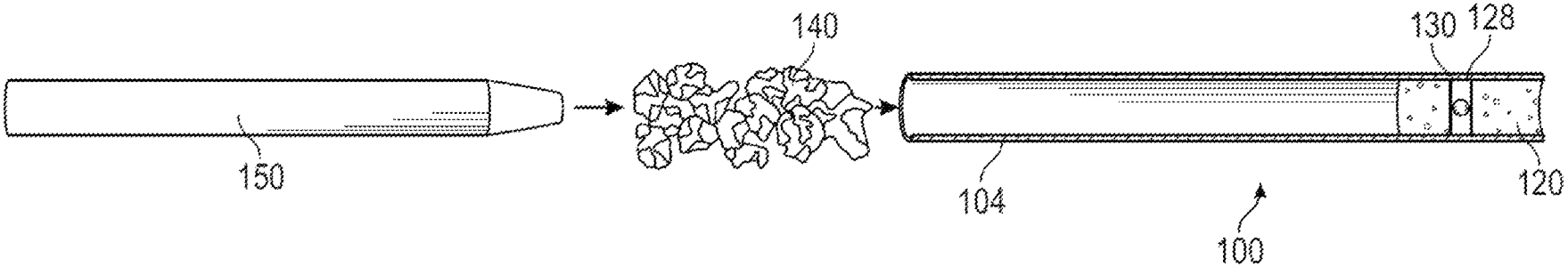
FIG. 7 is graphical depiction of the hollow tube of FIG. 1 in use.

FIG. 7 is graphical depiction of the hollow tube of FIG. 1 in use. In some embodiments a smoking material 140 can be inserted into the open end 104 of the hollow tube 100. A packing stick 150 can be used to compress the smoking material within the hollow tube 100 against the filter 120.

Figure 8:
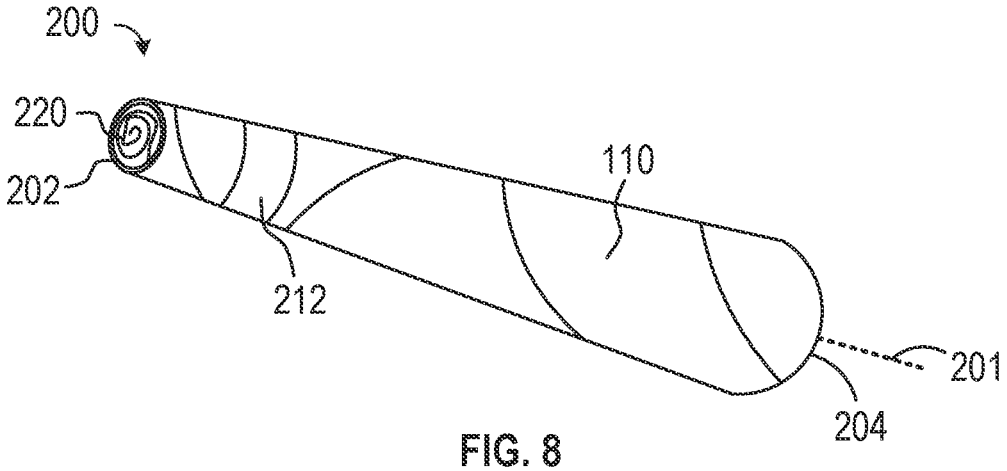
FIG. 8 is a perspective view of an embodiment of a hollow conical member.
Figure 9:
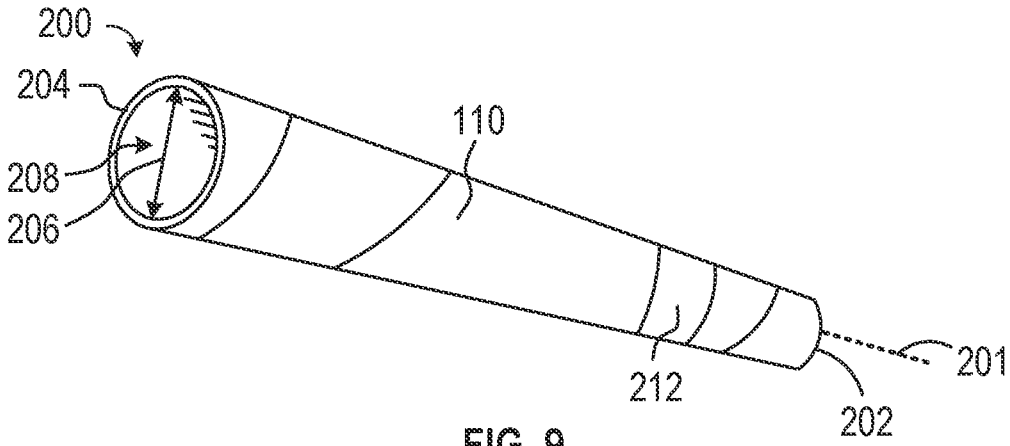
FIG. 9 is another perspective view of the hollow conical member of FIG. 8.
Figure 10:
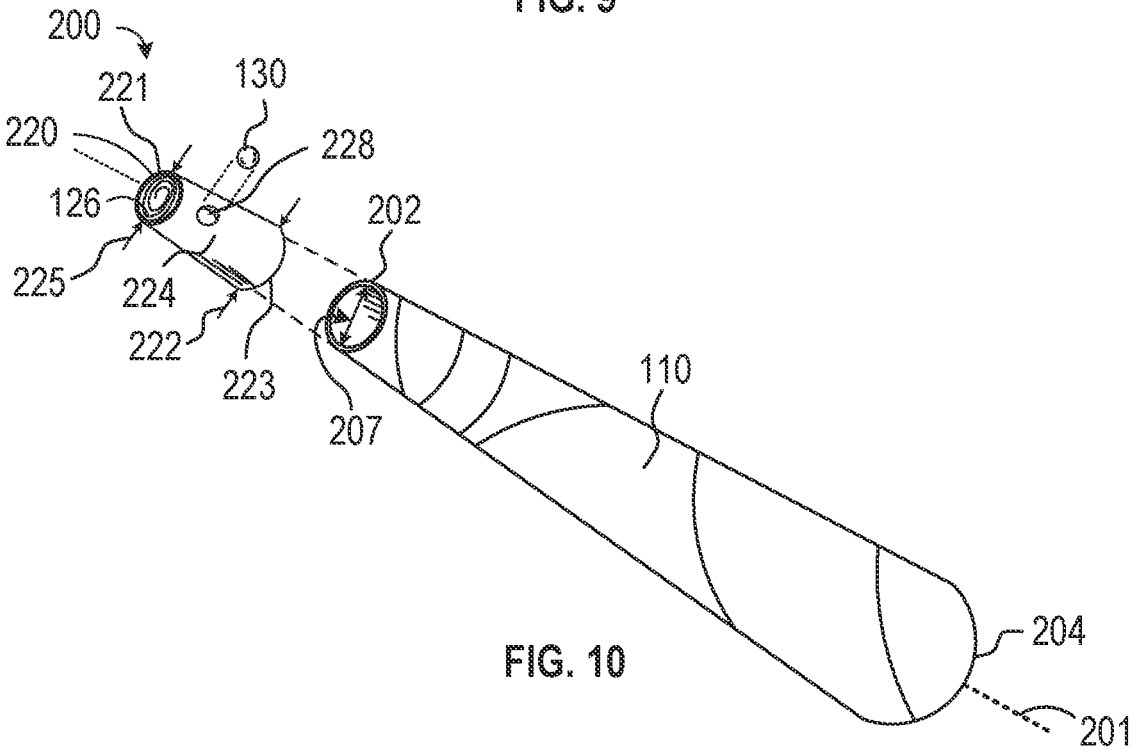
FIG. 10 is an exploded view of the hollow conical member of FIG. 9 and FIG. 10.

FIGS. 8-10 are perspective views of another embodiment of a hollow member in accordance with embodiments herein. FIGS. 8-10 depict a hollow member that is substantively the same the hollow tube of FIGS. 1-3, except that hollow member comprises a truncated conical shape formed of material 110 to provide a hollow truncated conical member 200 (referred to herein as hollow conical member 200). For example, the hollow conical member 200 can have an first outer diameter 203 at a first end 202 and second outer diameter 205 at a second end 204. The first outer diameter 225 may be smaller than the second outer diameter 222 and the hollow conical member 200 may include an outer shape extending from the first end 202 to a second end 204 forming the truncated conical shape. The first end 202 can have a filter 220, forming a closed end of the hollow conical member 200. The hollow conical member 200 can have a central axis 201 following an imaginary line through the center of the hollow conical member 200 from the first end 202 to the second end 204.

The second end 204 can open into an elongated internal cavity 208 having a second inner diameter 206 and the first end 202 can have a first inner diameter 207. The internal cavity 208 can receive smoking material 140 (see FIG. 7). In some implementations, as set forth above, the material 110 can be a dried leaf and/or a paper material. The leaf and/or paper can be rolled around a form and dried in place to form the material 110 of the hollow conical member 200. In some other examples, the leaf and/or paper can be (partially) dried and then rolled into the desired shape. The material 110 can be secured in a conical form with a ring 212. The ring 212 can be a section of paper or other appropriate fastener wrapped around and adhered to itself holding the material 110 in its conical hollow form and prevent the material 110 from unwrapping. The ring 212 can further be adhered to the material 110 to maintain the tubular shape.

FIG. 10 is an exploded view of the hollow conical member 200 of FIGS. 8 and 9. The filter 220 may be substantively similar to the filter 120, except that filter 220 can have a truncated body/shape extending from a first end 221 having a first outer diameter 221 to a second end 223 having a second outer diameter 222. The second outer diameter 222 may be larger than the first outer diameter 225. The first outer diameter 221 can be approximately equal to the inner diameter 207 of the first end 202 of the hollow conical member 200, such that the outer inclined surface of the filter 220 approximately equals the inner inclined surface of the hollow conical member 220. The filter 220 can be received within the first end 202 in an interference or friction fit. In some examples, the filter 220 can be rolled into the material 110 when forming the hollow conical member 220. In some implementations, the filter 220 can be removed and/or replaced from the hollow conical member 220 as needed.

The filter 220 can have a filter wrapper 224 (e.g., a plug wrap) enclosing a filter element 126. The filter element 126 can be formed from natural fibers. In some examples, the filter element 126 can be formed by rolling corn husks. The corn husks can be shredded and rolled (e.g., hand-rolled or machine-rolled) into a truncated conical shape, forming the filter element 126. In some implementations, the filter element 126 can be held in the truncated conical shape by the filter wrapper 224. The filter wrapper 224 can be a section of ordinary paper wrapped around the filter element 126. In other implementations, the filter 220 can be completely formed of corn husk without any paper. In some other implementations, the filter wrapper 224 can be one or more sections (e.g., lengths) of string formed from natural fibers. The string can be wrapped and tied around, for example, the ends of the filter element 126 to maintain a round shape.

In some implementations, the filter wrapper 224 can be a paper material as described above in connection to the material 110. Similarly, the filter element 126 may be made of can be a paper material.

In some implementations the hollow conical member 220 may be made entirely from a single material, for example, corn husk, paper material, etc. In some implementations, the hollow conical member 220 may be made entirely from palm paper (e.g., made from Cordia). For example, the material 110, filter wrapper 224, and filter element 126 may each be formed of palm paper. As another example, the hollow conical member 220 and the filter wrapper 224 may be formed of palm paper, while the filter element formed of corn husk, or other material as set forth above.

The filter 220 can have a recess 228, which is substantively similar to recess 128 described in connection to FIGS. 1-6. The recess 228 can be formed in a surface of the filter 220 along a curved face extending from the first end and the second end. For example, as described in connection to FIG. 4, the recess 228 can be a cavity or orifice bored, punched, or otherwise formed in the surface of the filter 220. The recess 228 can extend into the conical body of the filter 220.

In some implementations, the recess 228 can penetrate the wrapper 224 and extend radially through the filter element 126. The recess 228 can penetrate both the filter wrapper 224 and the filter element 126 extending completely through the filter 220. In other implementations, the recess 228 may not penetrate the wrapper 224 and thus be an indentation in the surface of the wrapper 126 and the filter 220.

In general, capsule 130 can be set within the recess 228 and thus contained within the recess 228 by the material 110 when the filter 220 is inserted within the hollow conical member 200. The recess 228 can be sized to receive a capsule 130. As explained above in connection to FIG. 5, when an external force is exerted anywhere along the filter 2220 adjacent to the closed end 202 of the hollow conical member 200 (e.g., on the capsule 130), the capsule 130 can be burst, releasing flavoring agent contained therein into the filter element 126. The external force may be applied anywhere along the length of the filter 220 such that the external force induces a pinching force applied to the capsule 130 within the filter element 126, thereby causing the capsule 130 to burst. The flavoring agent can be drawn into smoke that passes through the filter 220.

While the illustrative examples herein provide for a recess 228 formed in the surface of the filter 220, embodiments herein need not be so limited. For example, the recess 228 may be formed within the filter element 126 and the capsule 130 contained therein. In some embodiments, the filter member may be formed around the capsule 130, for example, by packing or rolling the filter element 126 around the capsule 130 forming recessing that contains the capsule 130. The filter wrapper 224 may then be applied and wrapped around the filter element 126. In another example, the filter element 126 may be placed on an unrolled filter wrapper 224 and the capsule 130 placed on the filter element 126 (e.g., in a central position of the filter element 126) and the filter wrapper 124 rolled to form the filter 220, thereby packing or rolling the filter element 126 around the capsule 130.

Figure 11:
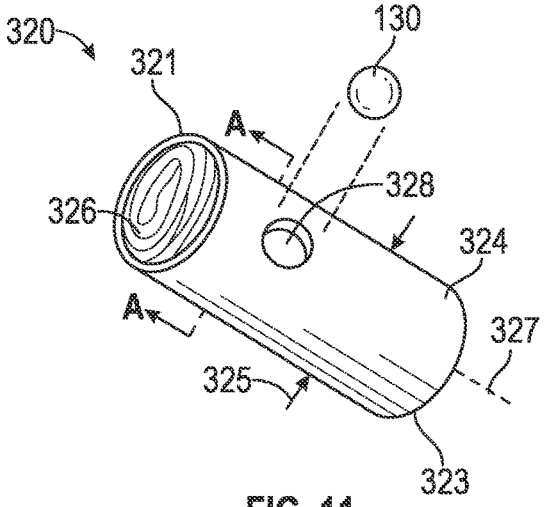
FIG. 11 is a perspective view of an embodiment of a filter.

FIG. 11 is a perspective view of an embodiment of a filter 320. In the illustrative example shown in FIG. 11, the filter 320 can have a cylindrical body/shape having an outer diameter 325 extending from a first end 321 to a second end 323. The filter 320 can have a central axis 327 following an imaginary line through the center of the filter 320 from the first end 321 to the second end 323. The description refers to axial and radial directions. Axial refers to directions along the central axis 327, while radial refers to a direction orthogonal to the central axis 327. The filter 320 may be configured to be received within an end of a tubular member in an interference or friction fit, for example, as described below in connection to FIGS. 14-15. In some examples, the filter 320 may be rolled into corn husk, dried leaf, or paper member (e.g., also referred to a wrap) when forming the tubular member. That is, in various embodiments, the filter 320 may be a distinct body that may, while used in conjunction with a separately provided tubular member, operate as a smoking accessory acting on smoke drawn through the filter 320.

The filter 320 can have a filter wrapper 324 (e.g., a plug wrap) enclosing a filter element 326. The filter element 326 can be formed from natural fibers. In some examples, the filter element 326 can be formed by rolling corn husks. The corn husks for the filter element 326 can be shredded and then rolled (e.g., hand-rolled or machine-rolled) into a cylindrical shape, forming the filter element 326. In some examples, the filter element 326 may be a paper material, such as any thin sheet material produced by processing fibers derived from plant or tree sources in water and then pressing and drying the material produce a sheet of material from which the filter element can be made. The paper material can be any type of paper, such as but not limited to, rice paper, hemp paper, palm paper (e.g. made by processing Cordia fibers), wood pulp, bleached paper (e.g., sometimes referred to as white paper), unbleached paper (e.g., sometimes referred to as brown paper), clear paper (e.g., paper made from cellulose resulting in a clear sheet), colored papers, gold rolling papers. For example, different paper material may be used to provide differing aesthetics, such as different colored papers or papers having designs printed thereon. In various examples, the material may be entirely made of palm paper (e.g. made by processing Cordia fibers).

In some implementations, the filter element 326 can be held in the cylindrical shape by the filter wrapper 324. The filter wrapper 324 can be a section of ordinary paper (e.g., kraft paper and the like) wrapped around the filter element 326. The paper material can be any type of paper, such as but not limited to, rice paper, hemp paper, palm paper (e.g. made by processing Cordia fibers), wood pulp, bleached paper (e.g., sometimes referred to as white paper), unbleached paper (e.g., sometimes referred to as brown paper), clear paper (e.g., paper made from cellulose resulting in a clear sheet), colored papers, gold rolling papers. In various examples, the material may be entirely made of palm paper (e.g. made by processing Cordia fibers). Using paper material, such as hemp paper, palm paper, etc., may provide benefits, such as for example but not limited to, being thinner and more flexible than the dried leaf embodiments described above. Particularly, palm paper may provide a material that is both thin and flexible, while resilient to breakage and/or tearing.

In other implementations, the filter 320 can be completely formed of corn husk without any paper. In some other implementations, the filter wrapper 324 can be one or more sections (e.g., lengths) of string formed from natural fibers. The string can be wrapped and tied around, for example, the ends of the filter element 326 to maintain a round shape.

In some implementations, the filter wrapper can be rolled around a shaped form and dried in place to form the body of the filter 320. In some examples, the filter wrapper can be (fully or partially) dried and then rolled into the desired shape. Optionally, the filter 320 can be secured in a tubular form, for example with a ring or string (not shown). The ring or string can be a section of paper or other appropriate fastener wrapped around and adhered to itself holding the filter wrapper in a hollow form/tubular shape and prevent the filter wrapper from unwrapping. The ring or string can further be adhered to the filter wrapper to maintain the tubular shape.

Embodiments described throughout this disclosure (for example, filter 320 and filter 520 described below) may provide various non-limiting advantages. For example, the filter and filter element packed therein may be configured to ensure that no loose smoking material inadvertently falls out of the tubular member. Additionally, the filter member 326 may prevent unwanted oils from entering a mouth of a user, for example, by absorbing oils produced by burning smoking material into the material of the filter element 326. Furthermore, implementations of filter 320 that employ corn husk as the filter wrapper 324 and/or filter element 326 may provide advantages over conventional paper, for example, by providing an all-natural smoking experience through the use of non-GMO, organic corn husk filter material. Additionally, corn husk material is exceptionally durable and resistant to tearing, enabling a user to manipulate the material free from damage concerns.

Figure 12:
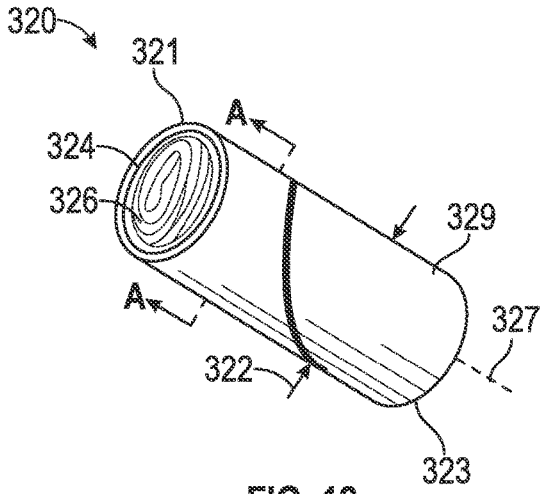
FIG. 12 is a perspective view of the filter of FIG. 12 including an outer casing.

FIG. 12 is a perspective view of an embodiment of the filter 320 including an outer casing 329. The filter 320 can have a tubular member formed as the outer casing 329 having an outer diameter of 322. The outer casing 329 can extend from the first end 321 to the second end 323.

The outer casing 329 can include elongated internal cavity extending between the first end 321 and the second end 323 along the central axis 327. The internal cavity can receive a filter wrapper 324 and filter element 326. The outer diameter 325 can be approximately equal to the diameter of the elongated internal cavity of the outer casing. The filter wrapper 324 and filter element 326 may be received within the first end 321 of the outer casing in an interference or friction fit. In the illustrative example of FIG. 9, the outer casing 329 overlaps in the radial direction with the filter wrapper 324 and filter element 326 along the entire length of the filter wrapper 324. In another example, the outer casing 329 may overlap with a portion of the filter wrapper 324 that is less than the entire length, thereby leaving the remaining portion or portions of the filter wrapper exposed.

In some implementations, the outer casing 329 can formed of dried leaf, corn husk, paper (e.g., kraft paper), and the like. In some implementations, the outer casing 329 can be a paper material, such as any thin sheet material produced by processing fibers derived from plant or tree sources in water and then pressing and drying the material produce a sheet of material. The paper material can be any type of paper, such as but not limited to, rice paper, hemp paper, palm paper (e.g. made by processing Cordia fibers), wood pulp, bleached paper (e.g., sometimes referred to as white paper), unbleached paper (e.g., sometimes referred to as brown paper), clear paper (e.g., paper made from cellulose resulting in a clear sheet), colored papers, gold rolling papers. For example, different paper material may be used to provide differing aesthetics, such as different colored papers or papers having designs printed thereon. In various examples, the material 110 may be entirely made of palm paper (e.g. made by processing Cordia fibers). Using paper material, such as hemp paper, palm paper, etc., may provide benefits, such as for example but not limited to, being thinner and more flexible than the dried leaf embodiments described above. Particularly, palm paper may provide a material that is both thin and flexible, while resilient to breakage and/or tearing.

In some examples, dried leaf can be any natural plant leaf that can be rolled into a tube. In some examples, the dried leaf can be a tree or plant leaf such as, cordia, manjack, bocote, palm, or other leaves. Cordia is a primary example used herein, but is not limiting on the disclosure. Cordia can include flowering plants (e.g., shrubs and trees) in the borage family, Boraginaceae. In general, the dried leaf can be a pure and all natural leaf (i.e., no additives), without glue or other adhesives, and green leaf. The dried leaf can also be tobacco free. The dried leaf can provide a resilient and aesthetically appealing green that burns slowly. When the outer casing is formed of corn husk, the corn husk can be rolled to form the tubular shape of the outer casing 329. The corn husk may pure and all natural (e.g., organic with no additives and non-GMO), without glue or other adhesives. The corn husk may be resilient to tearing and durable to provide a casing that holds the filter 320 together.

The outer casing 329 can be rolled around a form and dried in place to form the tubular member shape of the filter. In some examples, paper, dried leaf or corn husk can be (fully or partially) dried and then rolled into the desired shape. The outer casing 329 can be secured in a tubular form with a ring or string (not shown). The ring or string can be a section of paper or other appropriate fastener wrapped around and adhered to itself holding the outer casing in its hollow form/tubular shape and prevent the filter from unwrapping. The ring can further be adhered to the outer casing 329 to maintain the tubular shape.

In some implementations the filter 320 may be made entirely from a single material, for example, corn husk, paper material, etc. In some implementations, the filter 320 may be made entirely from palm paper (e.g., made from Cordia). For example, the filter wrapper 324, filter element 326, and the outer casing 329 may each be formed of palm paper. As another example, the outer casing 329 and the filter wrapper 324 may be formed of palm paper, while the filter element formed of corn husk, or other material as set forth above.

In an example method of forming the filter 320, the material of the filter element 326 may be layered on top of the material of the filter wrapper 324, which is layered on top of the material of the out casing 326. This layered arrangement forms a sheet of the various materials that may then be rolled (e.g., hand-rolled or machine-rolled) forming a long cylindrical shape. The resulting cylindrical shape may be cut at desired intervals along the axial length of the shape to form individual filters, such as filter 320.

The filter 320 can have a recess 328. The recess 328 can be formed in a surface of the filter 320 along a curved face extending from the first end and the second end.

In a manner similar to that described above in connection to FIG. 4, the recess 328 can be a cavity or orifice bored, punched, or otherwise formed in the surface of the filter wrapper 324. The recess 328 can extend into the cylindrical body of the filter 320. In some implementations, the recess 328 can penetrate the wrapper 324 and extend radially through the filter element 326. The recess 328 can penetrate both the filter wrapper 324 and the filter element 326 extending completely through the filter 320.

In other implementations, the recess 328 may not penetrate the wrapper 324 and thus be an indentation on the surface of the wrapper 326 and the filter 320. In general, a capsule 130 can be set within the recess 328 and thus contained within the recess 328 by the outer casing 329.

The recess 328 can be sized to receive the capsule 130. The capsule 130 can be a flavor capsule containing a flavoring agent. The capsule 130 can be a gelatin capsule. In other implementations, the capsule 130 can be formed from vegetable-based materials (e.g., a vegetable capsule). The flavoring agent can be a fluid operable to penetrate the filter element 326 and impart a flavor on the smoke drawn through the filter 320. The flavoring agent can be released when the capsule 130 is crushed. The flavoring agent within the capsule 130 can be, for example, a food grade essential oil or food grade candy oil. In some implementations, the flavoring agent can also include natural terpene liquid in various flavors (e.g., fruit or dessert flavors).

The recess 328 maybe be disposed at any axial position along the central axis 327 of the filter. For example, the recess 328 may be positioned closer to the first end 321 than the second end 323 along the axial direction. In this example, the first end 321 may be closer to a user's mouth than the second end 323, and thus the recess 328 and the flavor capsule may be adjacent to the mouth. In this arrangement, a user may have an improved experience as the flavoring agent is dispersed closer to the mouth of the user.

In another example, the recess 328 may be positioned closer to second end 323 or anywhere in between the first end 321 and the second end 323.

In some examples, the capsule 130 is removably received within the recess 328. The recess 328 may be larger than the size of the capsule 130 such that the capsule 130 is moves within the recess 328. In these examples, the capsule 130 may be removed from the recess 328 and a different capsule inserted therein. As another example, the capsule 130 may be easily inserted into the recess 328 without applying a force to the capsule 130 and/or filter 130. This may minimize risk of bursting the capsule 130 and/or deforming the filter 320 during manufacture. Whereas, in some scenarios, if the capsule 130 is held in place by friction fit, insertion of the capsule 130 into the recess 328 may result in damage to the capsule 130 and/or filter 320 unless the insertion is performed with extra care.

In examples comprising the outer casing 329, the outer casing 329 may be configured to contain the capsule within the recess 328. For example, where the recess 328 penetrates the filter wrapper 324, the outer casing 329 may be provided to cover the cavity, orifice or opening of the recess 328. When the capsule 130 is housed within this recess 329, the outer casing 329 seals the opening and the capsule 130 is securely held within the recess 328. Similarly, where the recess 328 does not penetrate the filter wrapper 324 and the capsule 130 is set within an indentation in the filter wrapper 324, the outer casing 329 may cover the indentation and thereby cover the capsule 130. Accordingly, embodiments are able to securely contain the capsule 130 within the designated area of the filter 320 corresponding to the recess 328 through the use of the outer casing.

As described above in connection to FIG. 5, when an external force 132 (e.g., a pinching motion) is exerted on the filter 320 (e.g., on the filter 320 and, thusly, the capsule 130), the capsule 130 can be burst, releasing the flavoring agent into the filter element 326. The external force may be applied to one or more of the first end 321, second end 323, and anywhere therebetween such that the external force induces a pinching force applied to the capsule 130 within the filter element 326, thereby causing the capsule 130 to burst. The flavoring agent can be drawn into smoke that passes through the filter 320.

In some implementations, the recess 328 can penetrate the wrapper 324 and extend radially into a portion of the filter element 326, as described in connection to FIG. 6, but not all the way through the filter 320. Thus, the recess 130 can thus form a pocket within the filter 320.

While the illustrative examples herein provide for a recess 328 formed in the surface of the filter 320, embodiments herein need not be so limited. For example, the recess 328 may be formed within the filter element 326 and the capsule 130 inserted into the recess. In some examples, the filter 320 may be formed around the capsule 130, for example, by packing or rolling the filter element 326 around the capsule 130 forming recess 328 that contains the capsule 130. The filter wrapper 324 may then be applied and wrapped around the filter element 326. In another example, the filter element 326 may be placed on an unrolled filter wrapper 324 and the capsule 130 placed on the filter element 326 (e.g., in a central position of the filter element 326) and the filter wrapper 326 rolled to form the filer 320, thereby packing or rolling the filter element 326 around the capsule 130.

While the forgoing description describes the filter 320 comprising outer casing 329, this is for illustrative purposes only. It will be appreciated the description applies equally to embodiments of filter 320 with or without the outer casing 329.

Figure 13:
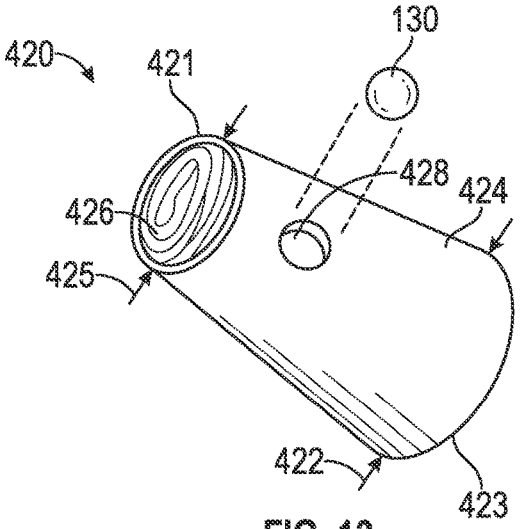
FIG. 13 is a perspective view of another embodiment of a filter.

FIG. 13 is a perspective view of another embodiment of a filter in accordance with embodiments herein. FIG. 13 depicts a filter 420 that is substantively similar to filter 320, except that filter 420 comprises a body having truncated conical shape. For example, filter 420 can have a first outer diameter 425 at a first end 421 and second outer diameter 422 at a second end 423. The first outer diameter 425 may be smaller than the second outer diameter 422 and the filter 420 may include an outer shape extending from the first end 421 to a second end 423 forming the truncated conical shape. Filter 420 can be received within an end of a truncated conical member in an interference or friction fit, for example, similar to that described in connection to FIG. 11 and as described below in connection to FIGS. 14-15. Unlike that described above, instead of a tubular member, filter 420 may be received at an end of a truncated conical member. In some examples, the filter 420 can be rolled into dried leaf or paper member (e.g., also referred to a wrap) when forming the truncated conical member.

The filter 420 can have a filter wrapper 424 (e.g., a plug wrap) enclosing a filter element 426. The filter element may be substantively similar to filter element 326 except that the filter element 426 corresponds to the truncated conical shape of the filter 420. That is, in some implementations, the filter element 426 can be held in the truncated conical shape by the filter wrapper 424. As with filter wrapper 324 of FIG. 11, the filter wrapper 424 can be a section of ordinary paper wrapped around the filter element 426. In other implementations, the filter 420 can be completely formed of corn husk without any paper. In some other implementations, the filter wrapper 424 can be one or more sections (e.g., lengths) of string formed from natural fibers. A string or band can be wrapped and tied around, for example, the ends of the filter element 426 to maintain a round shape.

The filter 420 can have a recess 428 sized to receive the capsule 130. The recess 428 may be substantively similar to that of recess 128 as described in connection to FIGS. 4-6. Accordingly, as described herein, when an external force 132 is exerted on the filter 420, the capsule 130 contained in recess 428 can be burst, releasing the flavoring agent into the filter element 426. The external force may be applied to one or more of the first end 421, second end 423, and anywhere therebetween such that the external force induces a pinching force applied to the capsule 430 within the filter element 426, thereby causing the capsule 430 to burst. The flavoring agent can be drawn into smoke that passes through the filter 420.

In some examples, the filter 420 may also comprise an outer casing (not shown) that is substantively similar to the outer casing 129 of FIG. 12. The outer casing for filter 420 has a truncated conical shape as described herein, opposed to the tubular shape of outer casing 329.

Figure 14:
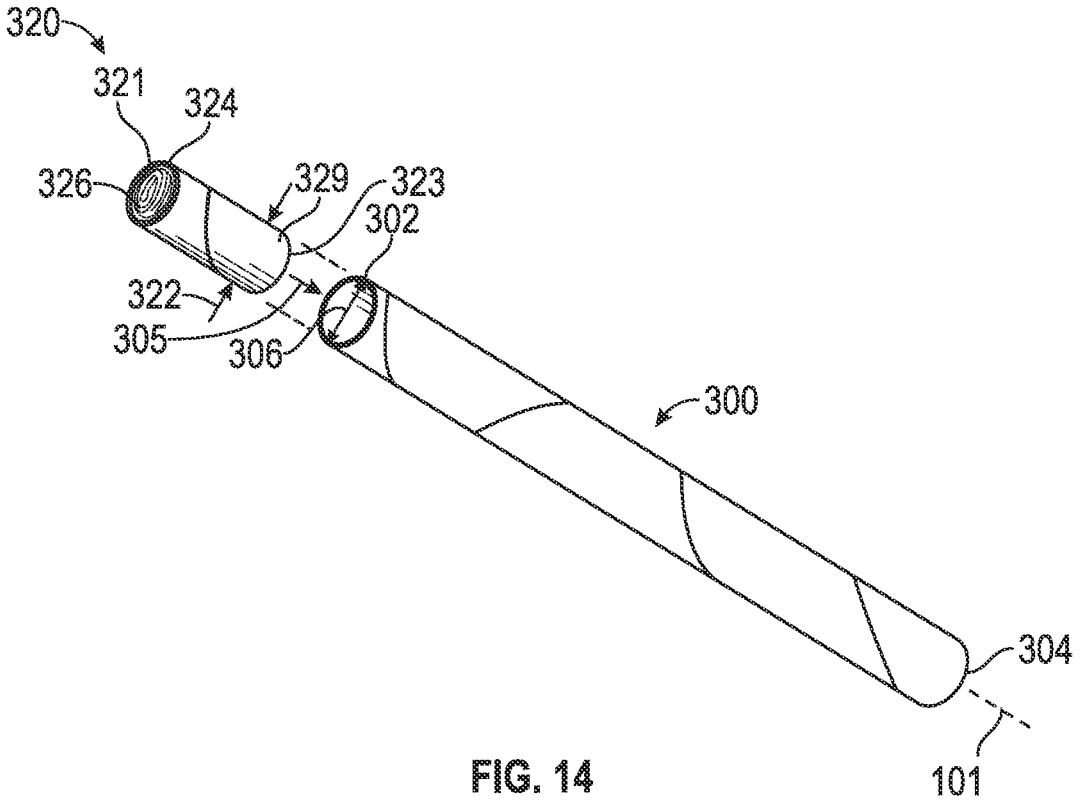
FIG. 14 is a perspective view of the filter received by an elongated member.
Figure 15:
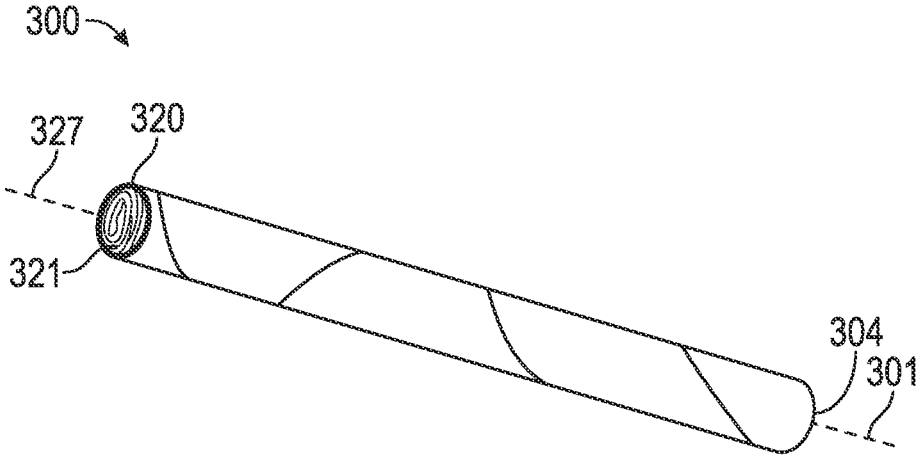
FIG. 15 is perspective view of the filter used with a hollow elongated member.

FIG. 14 is a perspective view of an embodiment of a filter, according to the embodiments disclosed herein, being received by a tubular member. FIG. 15 is another perspective view of the tubular member of FIG. 14 having received the filter according to the embodiments herein. While FIGS. 14 and 15 each illustrate the filter 320 comprising outer casing 329, this is for illustrative purposes only. The following description of FIGS. 14 and 15 each apply equally to embodiments of filter 320 with or without the outer casing 329.

The tubular member 300 can be a leaf tube formed from a dried leaf, paper material or a wrapper for enclosing smoking material (such as plant based smoking material). The tubular member 300 may be formed by a wrapper (e.g., kraft paper, dried leaf, or the like) that is rolled to form the tubular member 300. The material of the tubular member 300 may include material 110 described herein. For example, the tubular member may be formed of Cordia leaf and/or palm paper as described above. In some embodiments, a sheet of palm paper may be rolled around the filter 320 to form the tubular member 300.

The tubular member 300 can extend from a first end 302 to a second end 304. The first end 302 can be formed to receive the filter 320, forming a closed end of the tubular member 300. Receiving herein may refer to inserting the filter 320 into the first end 320 of the tubular member 300 (e.g., as shown by arrow 305). For example, where the filter 320 comprises the outer casing 329, the outer diameter 322 of the filter 320 can be received within end 302 of a tubular member 300 in an interference or friction fit. In another example, receiving as used herein may refer to placing the filter 320 onto the wrapper in an un-wrapped state and then forming the tubular member 300 around the filter 320. As another example, where the filter 320 does not include the outer casing 329, the outer diameter 325 of the filter 320 can be received within end 302 of a tubular member 300. That is, the filter 320 can be rolled into dried leaf or paper member when forming the tubular member 300.

The tubular member 300 can have a central axis 301 following an imaginary line through the center of the tubular member 300 from the first end 302 to the second end 304. A central axis 327 of the filter 320 may be substantially aligned with the central axis 301 of the tubular member 300.

The second end 304 can open into an elongated internal cavity 308 having an inner diameter 306. The internal cavity 306 can receive a smoking material 340 (see FIG. 15). In some implementations, dried leaf can be any natural plant leaf that can be rolled into the tubular member. In some examples, the wrapper or material forming the tubular member 300 can be a paper or tree or plant leaf such as, cordia, manjack, bocote, palm, or other leaves and/or processed fibers for forming paper. Cordia is a primary example used herein, but is not limiting on the disclosure. Cordia can include flowering plants (e.g., shrubs and trees) in the borage family, Boraginaceae.

While the preceding description is made with reference to a tubular member 300 receiving the filter 320, it will be appreciated that the preceding examples applies equally to the filter 420 of FIG. 12. For example, instead of tubular member 300, a truncated conical member may be provided that receives the filter 420. A first end of the truncated conical member may have a first diameter that is smaller than the diameter of a second end forming a truncated conical shape. In this configuration, the outer diameter 422 of the filter 420 can be received within the first end of the truncated conical member in an interference or friction fit. As another example, the filter 420 can be rolled into dried leaf or paper member within the first end when forming the truncated conical member.

Furthermore, the filter 320 may be received at a first end of a truncated conical member, while the filter 420 may be received at a first end 402 of a tubular member 100.

Other Aspects

The previous description is provided to enable any person skilled in the art to practice the various aspects described herein. Various modifications to these aspects will be readily apparent to those skilled in the art, and the generic principles defined herein may be applied to other aspects.

Thus, the claims are not intended to be limited to the aspects shown herein, but is to be accorded the full scope consistent with the language claims, wherein reference to an element in the singular is not intended to mean "one and only one" unless specifically so stated, but rather "one or more."

The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more.

Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A smoking accessory comprising:

a truncated conical member having a first cavity extending from an open end to a closed end, the first cavity being configured to receive smoking material;

a filter disposed within the first cavity and defining the closed end, the filter having a truncated conical body extending from a first end to a second end, a filter element formed of a first material and disposed within the truncated conical body, and a second cavity formed in the filter element, the second cavity having sides of the first material that are positioned along an axial direction of the filter element; and a capsule comprising a flavoring agent disposed within the second cavity, wherein the capsule contacts at least one of the sides of the second cavity.

2. The smoking accessory of claim 1, wherein the first material comprises one or more of corn husk and a paper material.

3. The smoking accessory of claim 1, wherein the filter is held in the first cavity by friction between the first cavity of the truncated conical body of the filter.

4. The smoking accessory of claim 1, wherein the filter comprises:

a filter wrapper formed of a second material and extending from the first end to the second end, the filter wrapper configured to accommodate the filter element disposed therein.

5. The smoking accessory of claim 4, wherein the second material is at least one of corn husk, paper, Cordia leaf, manjack leaf, bocote leaf, and palm leaf.

6. The smoking accessory of claim 4, wherein the second cavity penetrates the filter wrapper and extends radially into the filter element.

7. The smoking accessory of claim 6, further comprising:

an outer casing that houses the filter wrapper, wherein the outer casing covers the second cavity.

8. The smoking accessory of claim 1, wherein the truncated conical member is formed from a dried leaf.

9. The smoking accessory of claim 8, wherein the dried leaf comprises at least one of: Cordia leaf, manjack leaf, bocote leaf, and palm leaf.

10. The smoking accessory of claim 1, wherein crushing the capsule disperses the flavoring agent within the filter element.

11. A hollow leaf member comprising:

a truncated conical member having an elongated cavity extending from a first end to a second end, the elongated cavity being configured to receive smoking material;

a filter having a truncated conical body comprising a first material, the filter including a filter cavity having sides of the first material that are positioned along an axial direction of the filter; and a capsule disposed within the filter cavity, the capsule comprising a flavoring agent that, upon crushing the flavoring agent, disperses the flavoring agent that penetrates at least one of the sides of the filter cavity.

12. The hollow leaf member of claim 11, wherein the first material comprises one or more of corn husk and a paper material.

13. The hollow leaf member of claim 11, wherein the filter is held in the elongated cavity by friction between the elongated cavity of the truncated conical body of the filter.

14. The hollow leaf member of claim 11, wherein the filter comprises:

a filter element formed of the first material and housed in the truncated conical body; and a filter wrapper formed of a second material and configured to accommodate the filter element disposed therein.

15. The hollow leaf member of claim 14, wherein the second material is at least one of corn husk, paper, Cordia leaf, manjack leaf, bocote leaf, and palm leaf.

16. The hollow leaf member of claim 14, wherein the filter cavity penetrates the filter wrapper and extends radially into the filter element.

17. The hollow leaf member of claim 16, wherein the filter further comprises: an outer casing that houses the filter wrapper, wherein the outer casing covers the filter cavity.

18. The hollow leaf member of claim 11, wherein the truncated conical member is formed from a dried leaf.

19. The hollow leaf member of claim 18, wherein the dried leaf comprises at least one of: Cordia leaf, manjack leaf, bocote leaf, and palm leaf.

* * * * *